United States Patent [19]

Laitinen et al.

[11] 4,378,406

[45] Mar. 29, 1983

[54] THIN PLATINUM FILMS ON TIN OXIDE SUBSTRATES

[75] Inventors: Herbert A. Laitinen, Gainesville, Fla.; Donald C. Thornton, Philadelphia, Pa.

[73] Assignee: University of Florida, Gainesville, Fla.

[21] Appl. No.: 249,191

[22] Filed: Mar. 30, 1981

Related U.S. Application Data

[60] Continuation of Ser. No. 111,277, Jan. 11, 1980, abandoned, which is a division of Ser. No. 24,531, Mar. 28, 1979, Pat. No. 4,273,624.

[51] Int. Cl.[3] ..... B32B 15/04; C25D 5/18

[52] U.S. Cl. ..... 428/336; 428/340; 428/434; 428/469

[58] Field of Search ..... 428/434, 469, 336, 340; 204/23, 47

[56] References Cited

U.S. PATENT DOCUMENTS

| | | | |
|---|---|---|---|
| 3,340,097 | 9/1967 | Hess | 204/47 |
| 3,470,019 | 9/1969 | Steele | 428/434 |
| 3,619,235 | 11/1971 | Furuuchi | 428/434 |
| 3,674,675 | 7/1972 | Leaman | 204/290 F |
| 3,875,043 | 4/1975 | Franks | 204/240 F |
| 3,882,002 | 6/1975 | Cook, Jr. | 204/290 F |
| 3,940,323 | 2/1976 | Cook, Jr. | 204/290 F |
| 3,956,083 | 5/1976 | Cook, Jr. | 204/290 F |
| 3,986,942 | 10/1976 | Cook, Jr. | 204/290 F |

*Primary Examiner*—Ellis P. Robinson

*Attorney, Agent, or Firm*—Arthur G. Yeager

[57] ABSTRACT

A thin platinum film electrodeposited on a conductive tin oxide surface and a process for forming the coating.

5 Claims, No Drawings

THIN PLATINUM FILMS ON TIN OXIDE SUBSTRATES

The U.S. Government has rights in this invention pursuant to Grant Number CHE-75-08764 awarded by the National Science Foundation.

This is a Continuation, of application Ser. No. 111,277, filed Jan. 11, 1980, now abandoned which is a division of Ser. No. 024,531 filed Mar. 28, 1979, now U.S. Pat. No. 4,273,624.

BACKGROUND

This invention relates to the production of extremely thin films of platinum on electrically conductive tin oxide surfaces. The resulting material may be used for many of the purposes for which platinum is used, including heterogeneous catalysts for gas phase and liquid phase reactions and electrodes for electro-chemical processes. Also, this invention contemplates producing a thin platinum film on optically transparent tin oxide surfaces, wherein the property of optical transparency is retained while imparting the electrochemical properties of platinum to the tin oxide surface.

A well established technology exists for the production of electrically conductive tin oxide coatings on glass, quartz, and other ceramic bodies. U.S. Pat. No. 2,564,707, issued to John M. Mochel on Aug. 21, 1951 describes the preparation of such coatings by spraying aqueous tin-containing solutions upon heated surfaces of the substrate. A different type of procedure, involving the gas-phase decomposition of tin compounds onto solid surfaces is described, for example, in The Electrochemical Society, 123, 941 (1976), B. J. Baliga and S. K. Ghandi. Another recent work which deals with a vapor decomposition method of making tin oxide coatings is based on the reaction of stannic chloride ($SnCl_4$) with oxygen and is described in The Journal of the Electrochemical Society, 125, 110 (1978). Extensive use of tin oxide-coated glass as electrodes have been described in various literature articles. These uses include the study of electrode products by optical means, taking advantage of the transparency of such electrodes, as for example, J. W. Strojek and T. Kuwara, J. of Electroanalytical Chem. 16, 471 (1968). Other applications do not depend upon transparency, but take advantage of the low background currents and stability of such electrodes in acidic solutions at highly oxidizing potentials. (H. A. Laitinen, J. M. Conley, Anal. Chem., 48, 1224 (1976).

For many electrochemical applications, tin oxide electrodes are disadvantageous as compared with platinum because of high overpotentials, which result in prohibitive power losses in commercial processes. The use of a thin coating of platinum, in principle, makes it possible to extend the use of platinum by requiring much lighter loadings then are used at present. Examples of platinum-containing electrodes now in use include fuel cell membrane electrode: (as utilized, for example, by General Electric in the fuel cell power source in the early U.S. satellites), and platinized porous graphite electrodes used by Union Carbide in the aqueous, alkaline hydrogen-oxygen fuel cell.

Various methods have been developed in recent years which employ platinum metal and conductive tin oxide.

For example, U.S. patents issued to F. Beck, et. al. (3,672,990), J. H. Entwisle (3,701,724) and C. R. Franks et. al. (3,875,043 and 3,917,519) relate to coatings which include physical mixtures of platinum metals and/or the oxides thereof with tin oxide. However, none of the patents is directed to the concept of placing a platinum metal layer onto a conductive tin oxide layer.

U.S. Pat. No. 3,674,675 to F. H. Leeman discloses a platinum-coated electrode having a palladium substrate rather than one of tin oxide. Tin is used in the patented process (column 2, line 41) but only to provide sites for the deposition of palladium, the tin being completely replaced by palladium during this process. Similarly, U.S. Pat. No. 3,711,385 to H. Beer concerns the formation of a thick platinum oxide layer on the surface of several metals, not including tin or tin oxide.

Other prior art includes U.S. Pat. Nos. issued to E. H. Cook Jr. (3,882,002, 3,940,323, 3,956,083 and 3,986,942) describing an electrode which has a tin oxide substrate doped with elements such as molybdenum, tellurium, or antimony, and a surface layer of a metal or metal oxide from the platinum group of metals. The primary differences between the Cook inventions and the present invention includes: (1) Cook's outer coatings are noble metal oxides, while the present invention used platinum only; (2) although the general description in Cook (e.s. U.S. 3,940,323, col. 5, lines 25–26) mentions electroplating as a possibility, the detailed description employs only chemical decompositon methods to apply the metal oxide coating to the substrate; and (3) Cook's range of noble metal oxide coverage is 0.1 $g/m^2$ to 20 $g/m^2$ with a preferred range of 3–10 $g/m^2$ which is many times greater than that of the present invention. Further, the Cook patents fail to disclose whether the range of coverage measures the actual surface area or the projected area of the actual surface. The difference can be very large because the projected area fails to account for profile variations in the surface in the same way that an aerial photograph of mountainous terrain fails to show the actual surface area of the photographed terrain. It is the object of this invention to produce extremely thin films of platinum on electrically conductive tin oxide surfaces wherein the properties of the resulting project are rendered substantially similar to the properties of platinum itself.

Another object of the invention is to produce a thin platinum film on optically transparent tin oxide surfaces, wherein the property of optical transparency is retained while imparting the properties of platinum to the resulting product.

The novel features which are believed to be characteristic of this invention are set forth with particularity in the appended claims. The invention itself, however, both as to its organization and method of operation, together with further objects and advantages thereof, may best be understood by reference to the following description.

DESCRIPTION OF THE PREFERRED EMBODIMENTS

Conductive tin oxide coatings can be formed as adherent coatings on selected substrates according to well known processes. It is also well known that pure tin oxide ($SnO_2$) has a relatively high electrical resistance in comparison to other metals and that the electrical stability and conductivity may be improved through the introduction of a suitable amount of a dopant, such as antimony, or by the use of a non-stoichiometric tin oxide material. The term "tin oxide" is therefore construed to include not only pure tin oxide but also various "doped" tin oxides.

An extremely thin optically transparent surface layer of platinum metal is electrochemically applied to the optically transparent tin oxide substrate to form an optically transparent platinum metal-tin oxide coating. Where optical transparency is not a critical factor, the tin oxide layer may be much thicker. Regardless of the thickness of the tin oxide layer, a primary purpose of this invention is to produce a tin oxide substrate coated with the minimum amount of platinum metal to produce a product that has substantially the same electrochemical properties as an equivalent product that is solely platinum.

According to the preferred electrochemical procedure for producing a platinum metal-tin oxide coated electrode, a tin oxide electrode is inserted into an aqueous 0.1 M KCl solution containing $2\times10^{-4}$ M $H_2PtCl_6$, with the pH adjusted to the range of 4 to 10 typically and preferably, between about 6 and 7, and which may be a buffered solution. A three electrode system including a platinum counter electrode and a saturated calomel reference electrode is used. The potential is varied during the process from an initial potential range of about −0.1 to +0.5 v, preferably −0.1 to +0.3 v, (with respect to the saturated calomel electrode)), back to the positive potential. The effect of platinum film formation is observed after the first potential sweep cycle. Multiple cycles of potential sweep increase the amount of platinum on the tin oxide surface and improve the reactivity of the electrode.

The maximum amount of platinum per unit area can be estimated from the area of the current-time transient during the cathodic cycle. In one experiment this area amounted to 2000 microcoulombs/cm$^2$, which approximately corresponds to a coating weight of 1 microgram of platinum/cm$^2$ (or 10 milligrams/m$^2$). Observed current densities were on the order of $10^{-4}$ ampere/cm$^2$ for a polished tin oxide substrate. The behavior of an electrode prepared with the disclosed process compared with the behavior of an untreated tin oxide electrode and a pure platinum electrode in three solutions is shown in Table 1. For each of the three anodic processes involved, the platinum treatment substantially lowers the required anodic potential whereby the electrochemical properties of the platinum coated tin oxide are substantially similar to that of platinum alone.

TABLE 1

| | Potentials vs Saturated Calomel Electrode (Volts) | | |
|---|---|---|---|
| | Untreated Tin Oxide | Pt-Coated Tin Oxide | Platinum |
| Oxalic Acid (in 0.5 M $HClO_4$) | 1.7 | 0.7–0.9 | 0.7 |
| Formic Acid (in 0.7 M $HClO_4$) | 2.0 | 0.2–0.3 | 0.2–0.3 |
| Chloride ion (in 0.7 M $HClO_4$) | 2.2 | 1.2 | 1.2 |

The chemical nature of the platinum compound used in the preparative solution is not essential to the invention. The compound $H_2PtCl_6$ was chosen only as an example which is readily available. It has long been used in the preparation of "platinized platinum" or "platinum black" electrodes, but not to our knowledge in electrodeposition of platinum on tin oxide. For example, the soluble salts of chloroplatinic acid such as $(NH_4)_2PtCl_6$, $K_2PtCl_6$or $Na_2PtCl_6$ could be substituted for $H_2PtCl_6$.

Further, it has been found that the use of a potential varying with time is not an essential factor, but seems to provide better control, more uniform film formation, and minimizes the chemical attack of the coating, such as by hydrogen, during the coating process. A constant cathodic current or a constant potential can be used. Also, a relatively low potential with intermittent bursts of higher voltage can be employed. Likewise, a sinusoidal alternating potential or a sinusodal cathodic current produced by half-wave rectification of alternating current can be used in this process.

Although the observed current densities in the preferred procedure are on the order of $10^{-4}$ ampere/cm$^2$, current densities as high as 1 milliamp/cm$^2$ can be applied. One limiting factor is the increasing tendency of the tin oxide surface to interact with hydrogen as the current density increases. Therefore, it is recommended that a relatively low current density with intermittent bursts of a much higher current density, for periods on the order of a few microseconds be applied to the surface.

Previously published information concerning platinum plating processes discloses that platinum is electroplated at high cathodic current densities (greater than 0.1 ampere/cm$^2$) and at large overpotentials. However, such platings tend to be porous allowing the substrate to be attacked. In view of this fact, it was not originally anticipated that the disclosed process would produce very thin effective platinum coatings on tin oxide at low current densities. It was surprising to find, however, that the process of this invention produced an effective substitute for solid platinum employing much less of the expensive platinum metal than was previously thought necessary, and at a greatly reduced power consumption. Further, it was found that the platinum-coated tin oxide was applicable in various aqueous acids and bases, and for various anodic and cathodic processes. Further, it was found that a 1–10 Angstrom layer of platinum deposited on a tin oxide substrate imparted to the coated substrate the electrochemical properties of a solid platinum electrode.

Commercial uses of the invention include electrochemical applications, such as fuel cells; inert electrodes for chlorine production or other similar electrochemical processes; counter electrodes in applications such as electrowinning and recovery of trace metals from plant effluents; and oxygen gas-sensing electrodes such as those used in the automobile industry for monitoring the fuel-air ratio by analysis of exhaust manifold gas. Another area of application includes the heterogeneous catalyst systems used in many types of gas and liquid phase chemical processes. A specific example of use in an automobile catalytic converter where an extremely small amount of a platinum metal applied over a large surface area serves to connect noxious exhaust gases into environmentally acceptable materials.

While the invention has been described with respect to a certain specific embodiment, it will be appreciated that many modifications and changes may be made by those skilled in the art without departing from the spirit of the invention. It is intended therefore, by the appended claims to cover all such modifications and changes as fall within the true spirit and scope of the invention.

What is claimed as new and what it is desired to secure by Letters Patent of the United States is:

1. A product comprising a tin-oxide substrate surface-coated with a continuous platinum layer wherein the platinum layer has a weight not greater than substantially 1 microgram per square centimeter of non-projected, actual coated surface and wherein said product has substantially the same electrochemical properties as platinum.

2. A coated substrate according to claim 1 wherein the platinum layer has a thickness of about 1–10 Angstroms.

3. A coated substrate according to claim 1 wherein the platinum layer is optically transparent.

4. A coated substrate according to claim 1 wherein the platinum layer and tin oxide substrate are both optically transparent.

5. A coated substrate according to claim 1 in which the platinum layer is electroplated onto the tin oxide substrate.

* * * * *